US011201395B2

(12) United States Patent
Carpenter et al.

(10) Patent No.: US 11,201,395 B2
(45) Date of Patent: Dec. 14, 2021

(54) CAMOUFLAGED SINGLE BRANCH DUAL BAND ANTENNA FOR USE WITH POWER METER

(71) Applicant: Honeywell International Inc., Morris Plains, NJ (US)

(72) Inventors: Kerrance Carpenter, Wake Forest, NC (US); Gang Wei, Cary, NC (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 84 days.

(21) Appl. No.: 16/565,213

(22) Filed: Sep. 9, 2019

(65) Prior Publication Data

US 2021/0075098 A1 Mar. 11, 2021

(51) Int. Cl.

| | |
|---|---|
| ***H01Q 1/44*** | (2006.01) |
| ***H01Q 1/12*** | (2006.01) |
| ***H01Q 5/30*** | (2015.01) |

(52) U.S. Cl.

CPC ..... *H01Q 1/44* (2013.01); *H01Q 1/12* (2013.01); *H01Q 5/30* (2015.01)

(58) Field of Classification Search

CPC ..... H01Q 1/08; H01Q 1/085; H01Q 1/12; H01Q 1/22; H01Q 1/2233; H01Q 1/44; H01Q 5/30; H01Q 9/16; H01Q 9/285

See application file for complete search history.

(56) References Cited

U.S. PATENT DOCUMENTS

| | | | |
|---|---|---|---|
| 5,553,094 A | 9/1996 | Johnson et al. | |
| 6,218,995 B1 | 4/2001 | Higgins et al. | |
| 6,262,685 B1 | 7/2001 | Welch et al. | |
| 6,885,185 B1 | 4/2005 | Makinson et al. | |
| 7,129,900 B2 * | 10/2006 | De Angelis | H01Q 1/2233 343/719 |
| 7,196,673 B2 | 3/2007 | Savage et al. | |
| 7,317,404 B2 | 1/2008 | Cumeralto et al. | |
| 7,372,373 B2 | 5/2008 | Borisov et al. | |
| 7,453,373 B2 | 11/2008 | Cumeralto et al. | |
| 7,671,814 B2 | 3/2010 | Savage et al. | |
| 7,973,673 B2 | 7/2011 | Payne et al. | |
| 7,994,990 B2 | 8/2011 | Stoufer et al. | |
| 7,994,994 B2 | 8/2011 | Savage et al. | |
| 8,284,107 B2 | 10/2012 | Borisov et al. | |
| 8,299,975 B2 | 10/2012 | Savage et al. | |
| 8,462,060 B2 | 6/2013 | Savage et al. | |
| 8,774,707 B2 | 7/2014 | Flammer, III et al. | |
| 8,931,337 B2 | 1/2015 | Renoud et al. | |

(Continued)

OTHER PUBLICATIONS

"Power Meter with Antenna 2118284-1 Rev," 1 page, Jun. 2018.

*Primary Examiner* — Jason Crawford

(74) *Attorney, Agent, or Firm* — Seager, Tufte & Wickhem, LLP

(57) ABSTRACT

A dual band antenna is configured for use with a power meter having a power meter housing. The dual band antenna includes a flexible polymeric substrate and an adhesive layer that is secured relative to the flexible polymeric substrate. A first conductive element is disposed relative to the flexible polymeric substrate and has a first electrical length. A second conductive element is disposed relative to the flexible polymeric substrate and has a second electrical length. The first electrical length and the second electrical length are substantially the same.

20 Claims, 7 Drawing Sheets

(56) References Cited

U.S. PATENT DOCUMENTS

2003/0179149 A1* 9/2003 Savage ..... H01Q 1/40 343/873
2005/0083235 A1 4/2005 Savage et al.
2005/0190074 A1 9/2005 Cumeralto et al.
2005/0200554 A1* 9/2005 Chau ..... H01Q 1/36 343/895
2006/0055610 A1 3/2006 Borisov et al.
2006/0114121 A1 7/2006 Cumeralto et al.
2006/0284784 A1* 12/2006 Smith ..... G01D 4/008 343/872
2007/0063915 A1 3/2007 Savage et al.
2008/0129536 A1* 6/2008 Randall ..... H01Q 1/2233 340/870.02
2008/0238711 A1 10/2008 Payne et al.
2008/0316087 A1 12/2008 Stoufer et al.
2010/0097287 A1* 4/2010 Pakosz ..... H01Q 21/30 343/821
2010/0110617 A1 5/2010 Savage et al.
2010/0201514 A1 8/2010 Barna et al.
2010/0253538 A1* 10/2010 Smith ..... G01D 4/008 340/870.02
2011/0038104 A1 2/2011 Payne et al.
2011/0063172 A1* 3/2011 Podduturi ..... H01Q 1/38 343/700 MS
2011/0149544 A1* 6/2011 Khan ..... H01Q 1/526 361/807
2011/0163925 A1 7/2011 Savage et al.
2012/0098710 A1* 4/2012 Seal ..... H01Q 1/2233 343/702
2013/0050033 A1 2/2013 Savage et al.
2013/0091945 A1 4/2013 Renoud et al.
2013/0099938 A1 4/2013 Borisov et al.
2013/0157559 A1 6/2013 Flammer, III et al.
2020/0076067 A1* 3/2020 McCraven ..... H01Q 1/42

* cited by examiner

CAMOUFLAGED SINGLE BRANCH DUAL BAND ANTENNA FOR USE WITH POWER METER

TECHNICAL FIELD

The present disclosure relates generally to antennas and more particularly relates to dual band antennas suitable for use with power meters.

BACKGROUND

A variety of electrical devices rely upon antennas to facilitate communication between the electrical devices. As a particular example, some power meters are configured to communicate with other power meters, gateways and/or other devices. In some cases, there is a need for power meters to communicate using more than one communication band. What would be desirable is a dual band antenna that can be used to facilitate communication with power meters over more than one communication band in a reliable and efficient manner.

SUMMARY

The present disclosure relates generally to antennas, and more particularly to dual band antennas that can be used to facilitate communication with power meters over more than one communication band in a reliable and efficient manner. An example of the disclosure includes a dual band antenna that is configured for use with a power meter having a power meter housing. The illustrative dual band antenna includes a flexible polymeric substrate and an adhesive layer that is secured relative to the flexible polymeric substrate. A first conductive element is disposed relative to the flexible polymeric substrate and has a first electrical length. A second conductive element is disposed relative to the flexible polymeric substrate and has a second electrical length. The first electrical length and the second electrical length are substantially the same.

Another example of the disclosure includes an antenna assembly that is configured for use with a power meter having a power meter housing with a curved side wall. The illustrative antenna assembly includes a flexible substrate that is configured to fit about at least a portion of the curved side wall of the power meter housing. A dual band antenna is secured relative to the flexible substrate and is configured to have, when curved around the curved side wall of the power meter housing, a first resonance peak between 902 MHz and 928 MHz of the ISM-900 MHz band and a second resonance peak between 2.4 GHz and 2.5 GHz. In some cases, the dual band antenna is vertically polarizing to help increasing its horizontal sensitivity when the power meter is in its mounted configuration.

Another example of the disclosure includes a power meter that is configured for use with a power socket. The illustrative power meter includes a power meter housing that defines a curved side wall and a power meter that is disposed within the power meter housing. A dual band antenna is coupled to the curved outer facing side wall of the power meter housing and provides, when curved around the curved side wall of the power meter housing, a first resonance peak between 902 MHz and 928 MHz of the ISM-900 MHz band and a second resonance peak between 2.4 GHz and 2.5 GHz. The illustrative power meter may include a clear cover that is disposed over the power meter housing and the dual band antenna.

The preceding summary is provided to facilitate an understanding of some of the innovative features unique to the present disclosure and is not intended to be a full description. A full appreciation of the disclosure can be gained by taking the entire specification, claims, figures, and abstract as a whole.

BRIEF DESCRIPTION OF THE FIGURES

The disclosure may be more completely understood in consideration of the following description of various examples in connection with the accompanying drawings, in which.

Figure 1:
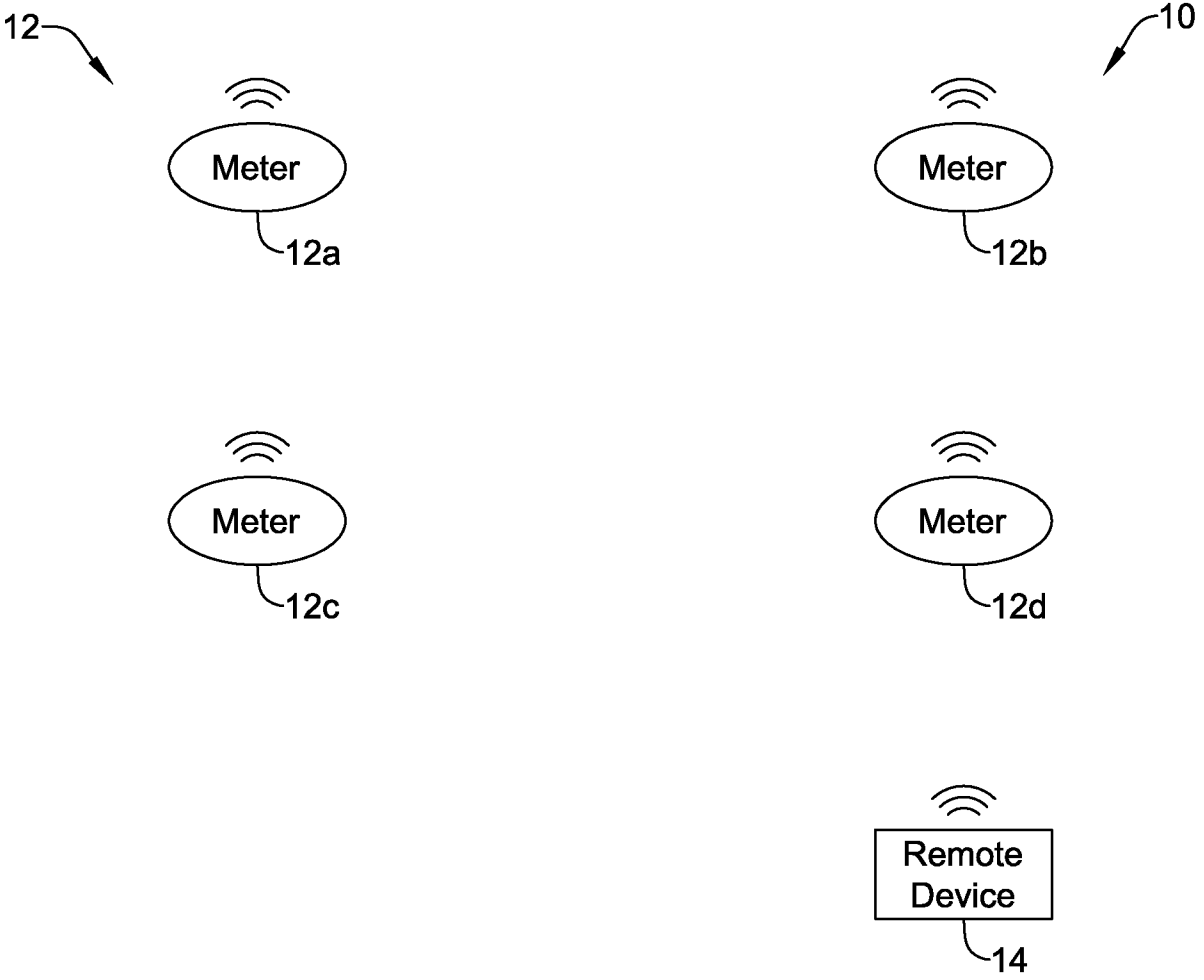
FIG. 1 is a schematic diagram showing a network of illustrative communicating power meters.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

DESCRIPTION

The following description should be read with reference to the drawings, in which like elements in different drawings are numbered in like fashion. The drawings, which are not necessarily to scale, depict examples that are not intended to limit the scope of the disclosure. Although examples are illustrated for the various elements, those skilled in the art will recognize that many of the examples provided have suitable alternatives that may be utilized.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram of a network 10 of power meters 12. While a total of four power meters 12*a*, 12*b*, 12*c*, 12*d* are shown, it will be appreciated that the network 10 may include any number of power meters 12. In some cases, for example, the network 10 may include hundreds or even thousands of power meters 12. In some cases, the power meters 12 may be configured to communicate with neighboring power meters, forming a mesh network. Also, one or more power meters 12 that are in communication range with a remote device 14 may also communicate with the remote device 14. The remote device 14 may be a gateway, wireless router, desktop computer, cloud-based computer and/or any other suitable remote device 14. The remote device 14 may be part of a power distribution network, and may for example be involved in receiving power consumption data for each of the individual power meters 12*a*, 12*b*, 12*c*, 12*d* via the network 10 and ultimately billing each of the houses, condominiums, townhouses or businesses individually represented by each of the individual power meters 12*a*, 12*b*, 12*c*, 12*d*.

As will be appreciated, the power meters 12 may be configured to communicate wirelessly. In some instances, the power meters 12 may be configured to communicate with other power meters using a first communication band and may communicate with other device such as but not limited to the remote device 14 using a second, different communication band. It will be appreciated that a particular communication band may have certain advantages and certain disadvantages while a different particular communication band may have a different set of certain advantages and certain disadvantages. There may be a tradeoff between communication speed and communication range, for example. There are a variety of known wireless communication protocols, such as cellular communication, ZigBee, REDLINK™ Bluetooth, WiFi, IrDA, dedicated short range communication (DSRC), EnOcean, and/or any other suitable common or proprietary wireless protocol, as desired.

In some cases, one of the communication bands used by the power meters 12 may be centered between 902 MHz and 928 MHz of the Industrial, Scientific and Medical (ISM) ISM-900 MHz (megahertz) band. Another of the communication bands used by the power meters may be centered between 2.4 GHz (gigahertz) and 2.5 GHz. These are just examples. The power meters 12*a*, 12*b*, 12*c*, 12*d* may each include a dual band antenna that allows the power meter 12*a*, 12*b*, 12*c*, 12*d* to communicate using a first communication band and a second communication band, without needing separate antenna assemblies for each of the communication bands. In some cases, the power meters 12*a*, 12*b*, 12*c*, 12*d* may each have a dual band antenna that is configured to have a first receiving band that is centered between 902 MHz and 928 MHz of the ISM-900 MHz band and a second receiving band that is centered between 2.4 GHz and 2.5 GHz. Again, this is just one example.

Figure 2:
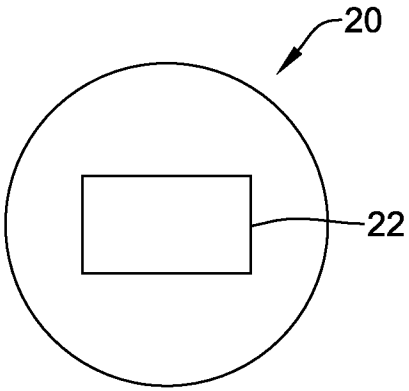
FIG. 2 is a front plan view of an illustrative power socket usable to secure a power meter such as the power meters shown in FIG. 1.

FIG. 2 is a front plan view of a power socket 20 that may, for example, be used to electrically connect to and mechanically secure one of the power meters 12 to a building or the like. The power socket 20 may be mechanically coupled to a wall or other building structure, and may include an electrical socket 22 that enables a power meter 12 to electrically couple to the power supply within the building.

Figure 4:
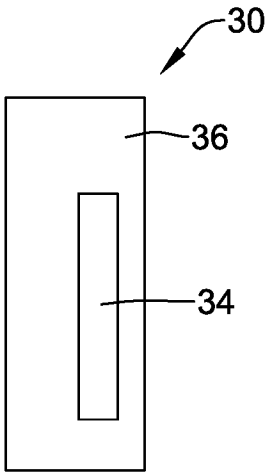
FIG. 4 is a side plan view of the illustrative power meter of FIG. 3.
Figure 3:
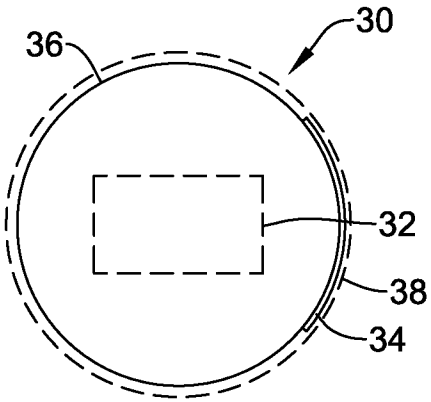
FIG. 3 is a front plan view of an illustrative power meter usable with the power socket of FIG. 2.

FIG. 3 is a front plan view of a power meter 30 while FIG. 4 is a side plan view thereof. The power meter 30 may be considered as being an example of one of the power meters 12*a-d*. The power meter 30 includes an electrical coupler 32 that is configured to electrically engage with the electrical socket 22 and allow the power meter 30 to monitor power consumption within the building. This may include routing the building current through the power meter 30. This can produce significant electro-magnetic noise in the power meter 30. As seen in FIG. 3, a dual band antenna 34 is secured to an outer surface of the power meter 30. By placing the dual band antenna 34 along the outer surface of the power meter 30, instead of inside of the power meter 30, the dual band antenna 34 may be spaced further from the electro-magnetic noise that may be generated in the power meter 30.

In the example shown, the illustrative power meter 30 has a cylindrical shaped housing, where the housing defines a curved side wall 36, and the dual band antenna 34 is secured to the curved side wall 36. As a result, the dual band antenna 34 may be seen as having a curved profile when in use. In some cases, the dual band antenna 34 may be tuned or otherwise configured to have particular performance characteristics when in a curved profile. In some cases, a clear cover 38 may fit onto the power meter 30, and protect the dual band antenna 34 from environmental conditions, vandalism and tampering.

Figure 5:
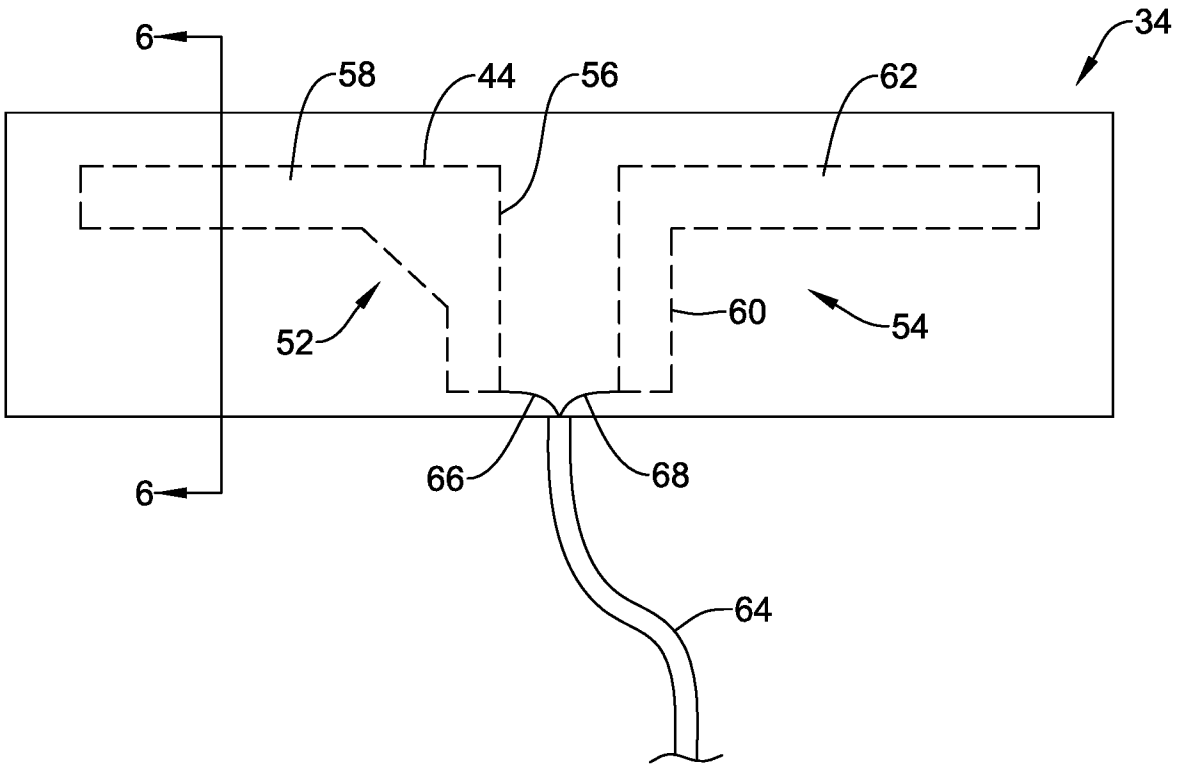
FIG. 5 is a front plan view of an illustrative dual band antenna usable with the illustrative power meter of FIG. 3.
Figure 6:
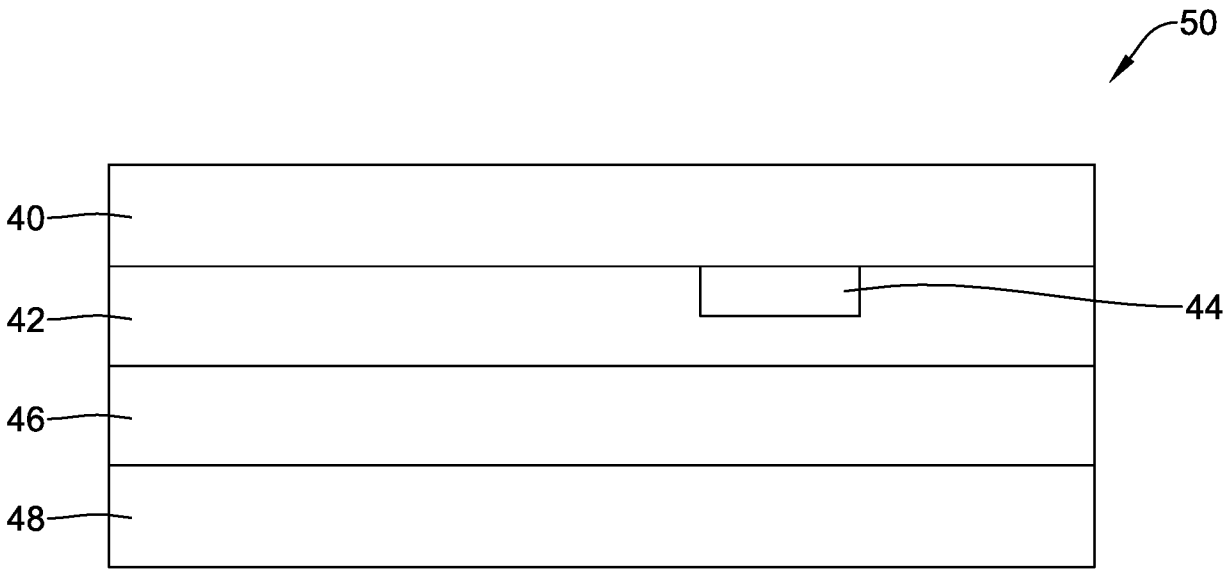
FIG. 6 is a cross-sectional view of the illustrative dual band antenna, taken along the line 6-6 of FIG. 5.

FIG. 5 is a front plan view of the dual band antenna 34 and FIG. 6 is a cross-sectional view of the dual band antenna 34, taken along the line 6-6 in FIG. 5. As can be seen, the illustrative dual band antenna 34 has a multiple layer construction. The illustrative dual band antenna 34 includes a first polymeric layer 40 that may be considered as forming a front of a flexible polymeric substrate 50 and a second polymeric layer 42 that is behind the first polymeric layer 40. The first polymeric layer 40 may be formed of an electrically insulating polyimide. As will be discussed, the first polymeric layer 40 may be tinted or otherwise colored. The second polymeric layer 42 may be formed of an electrically insulating polyimide. In some cases, a conductive layer 44 may be sandwiched between the first polymeric layer 40 and the second polymeric layer 42. The flexible polymeric substrate 50 may be considered as including an adhesive layer 46 that is intended to secure the dual band antenna 34 to the curved outer side wall 36 of the cylindrical shaped housing of the power meter 30. A removable liner 48 may protect the adhesive layer 46 from contaminants until such time as the removable liner 48 is removed just prior to securing the dual band antenna 34 to the power meter 30.

The conductive layer 44 may be considered as including a first conductive element 52 and a second conductive element 54. The first conductive element 52 may be considered as including a first portion 56 that extends towards the front of the power meter housing (vertically in the illustrated orientation) and a second portion 58 that extends from the first portion 56 and laterally (horizontally in the illustrated orientation) of the first portion 56. The second conductive element 54 may be considered as including a first portion 60 that extends towards the front of the power meter housing (vertically in the illustrated orientation) and a second portion 62 that extends from the first portion 60 and laterally (horizontally in the illustrated orientation) of the first portion 60.

The first conductive element 52 may be considered as having a first electrical length. The second conductive element 54 may be considered as having a second electrical length. In some cases, the first electrical length may be substantially equal to the second electrical length. In this, the electrical length of an electrical conductor may be defined in terms of the phase shift that is introduced by transmission over that electrical conductor at a given frequency. Saying that the first electrical length is substantially equal to the second electrical length may be interpreted as meaning that the first electrical length is within plus or minus 1 percent of the second electrical length. Having the first electrical length be equal or substantially equal to the second electrical length means that the dual band antenna 34 is balanced. As a result of being balanced, the dual band antenna 34 may be vertically polarized, which in turn may result in the dual band antenna 34 having a better horizontal range when the power meter is in its mounted configuration (e.g. mounted to a socket in the building). In the example shown, the dual band antenna 34 is considered a single branch antenna, rather than a dual branch antenna.

The dual band antenna 34 may communicate with a corresponding transceiver of the power meter 30 via a two-conductor coaxial cable 64. The coaxial cable 64 may include a first conductor 66 that is electrically coupled to the first conductive element 52 and a second conductor 68 that is electrically insulated from the first conductive element 52 and is electrically coupled to the second conductive element 54. The coaxial cable 64 may be configured to mechanically and electrically coupled to a transceiver or the like via appropriate connector within the power meter 30.

In some cases, the first polymeric layer 40 may be configured to have a color that is substantially the same as a color of the outer housing of the power meter 30. It has been found that in some cases, an antenna visible on the exterior of a power meter may be viewed as an attractive nuisance inviting vandalism or tampering. Thus, in some cases, the dual band antenna 34 may be configured to have an outer appearance that is relatively difficult to see unless quite close to the power meter 30. As an example, the first polymeric layer 40 may be tinted, painted or otherwise colored such that it is difficult to see a difference. In some cases, the dual band antenna 34 may have a color such that a visible difference between a color of the dual band antenna 34 and a color of the adjacent power meter housing may be less than a just noticeable difference (JND). The JND is defined as the amount that something must be changed in order for a difference to be noticeable (or detectable) at least half of the time. See Weber's Law of Just Noticeable Difference, University of South Dakota, as referenced at http://apps.usd.edu/coglab/WebersLaw.html.

As an example, if the power meter 30 has a housing that is light gray, then the dual band antenna 34 may be configured to be light gray. If the power meter 30 has a housing that is black, then the dual band antenna 34 may be configured to be black. It will be appreciated that by having a colored front polymeric layer 40, the conductive layer 44 itself is not immediately noticeable, which also helps to lessen the obviousness of the dual band antenna 34.

Figure 7:
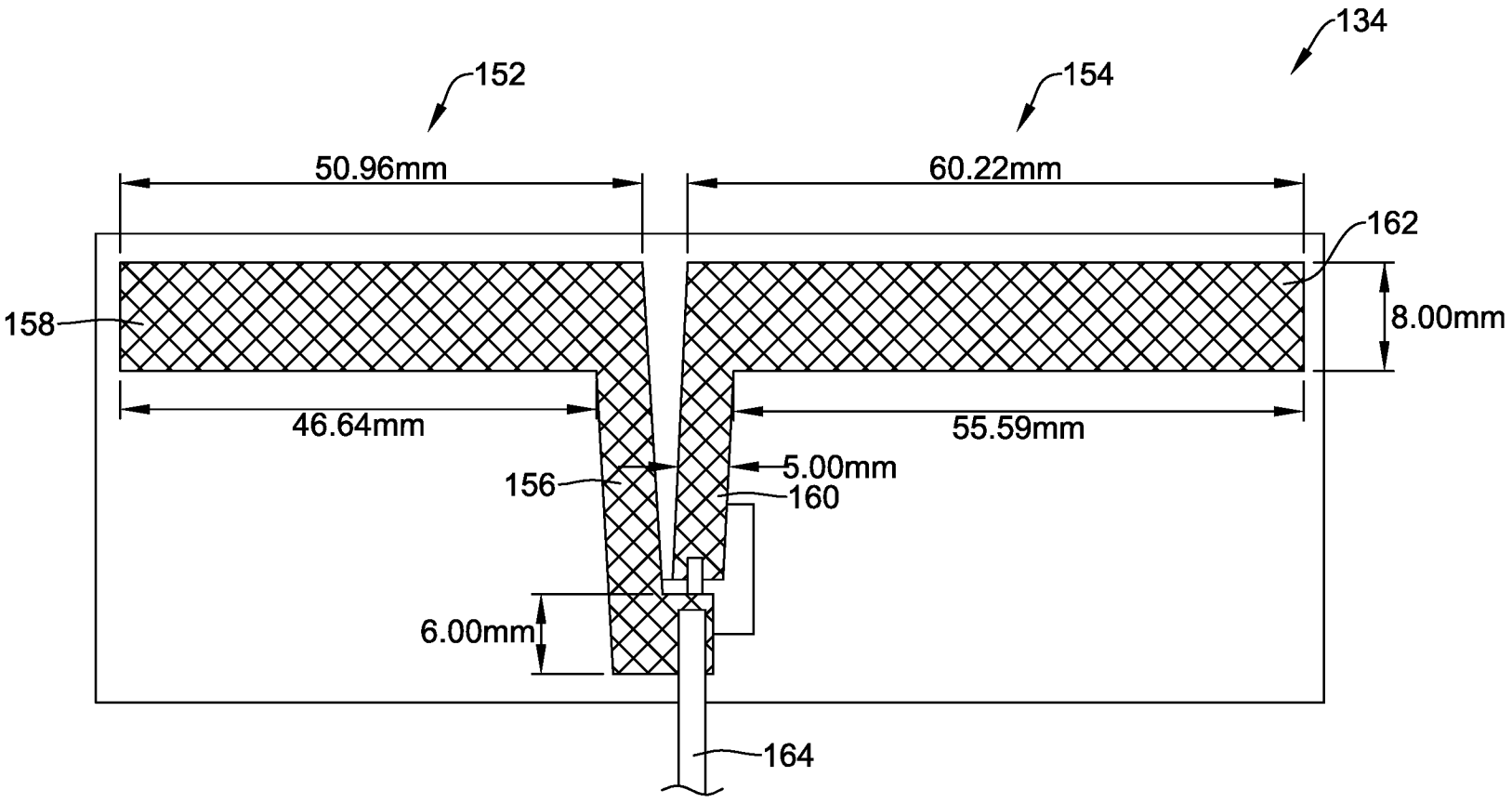
FIG. 7 is a schematic view of an example dual band antenna.

FIG. 7 is a schematic view of an illustrative dual band antenna 134 that may be considered as being a particular example of the dual band antenna 34. The illustrative dual band antenna 134 includes a first conductive element 152 and a second conductive element 154. The first conductive element 152 may be considered as including a first portion 156 that extends towards the front of the power meter housing (vertically in the illustrated orientation) and a second portion 158 that extends from the first portion 156 and laterally (horizontally in the illustrated orientation) of the first portion 156. The second conductive element 154 may be considered as including a first portion 160 that extends towards the front of the power meter housing (vertically in the illustrated orientation) and a second portion 162 that extends from the first portion 160 and laterally (horizontally in the illustrated orientation) of the first portion 160.

The first conductive element 152 may be considered as having a first electrical length. The second conductive element 154 may be considered as having a second electrical length. In some cases, the first electrical length may be substantially equal to the second electrical length. As can be seen, FIG. 7 includes particular measurements. It is considered that these dimensions contribute to the first conductive element 152 having an electrical length that is equal to or substantially equal to an electrical length of the second conductive element 154, and are design to produce a first resonance peak between 902 MHz and 928 MHz of the ISM-900 MHz band and a second resonance peak between 2.4 GHz and 2.5 GHz. Having the first electrical length be equal or substantially equal to the second electrical length means that the dual band antenna 134 is balanced. As a result of being balanced, the dual band antenna 134 may be vertically polarized, which in turn may result in the dual band antenna 134 having a better horizontal range when the corresponding power meter is in its mounted configuration (e.g. mounted to a socket in the building). In the example shown, the dual band antenna 134 is considered a single branch antenna, rather than a dual branch antenna.

Figure 8:
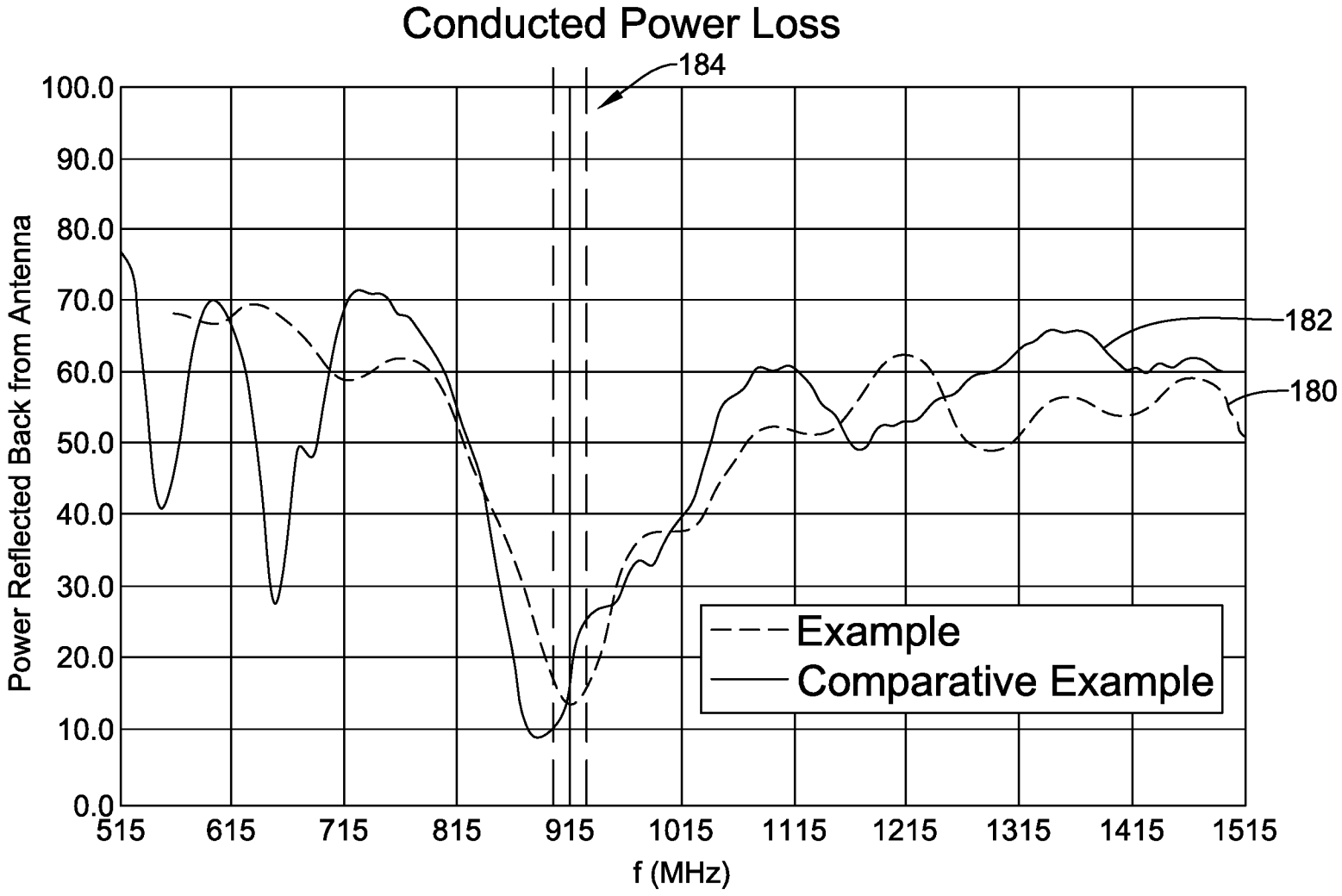
FIG. 8 is a graphical representation of conducted power loss showing a comparison between the example dual band antenna of FIG. 7 and a commercially available comparison product.

FIG. 8 is a graphical representation of Conducted Power Loss for the dual band antenna 134 relative to a commercially available comparative example. This is a plot of power reflected back from the antenna (Y-axis) relative to Frequency (X axis). Graphed line 180 shows the data for the dual band antenna 134 while graphed line 182 shows the corresponding data for the comparative example. By comparing the graphed line 180 with the graphed line 182, several things can be seen. For example, the graphed line 180, representing the dual band antenna 134 is well centered in a band of interest, indicated by the dashed lines 184. In contrast, the graphed line 182, representing the comparative example, is poorly centered in the band of interest 184. Another difference is that in looking at the graphed line 180, overall there is a smooth transition in power reflected back as approaching (from either direction) the band of interest 184. In contrast, this does not appear in the graphed line 182. In particular, this can be seen in the graphed line 182, which oscillates up and down repeatedly at lower frequencies.

Figure 9:
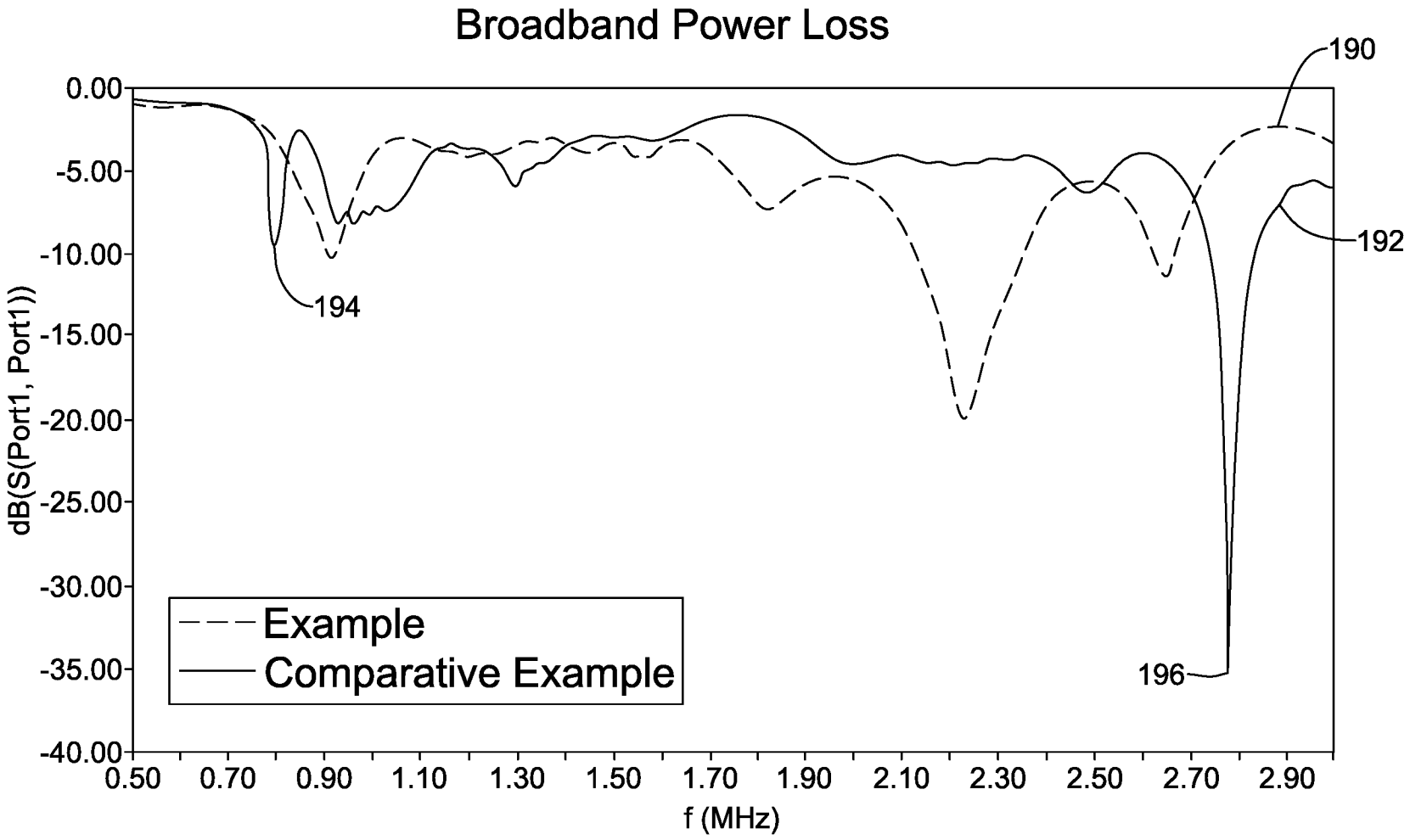
FIG. 9 is a graphical representation of broadband power loss showing a comparison between the example dual band antenna of FIG. 7 and a commercially available comparison product.

FIG. 9 is a graphical representation of Broadband Power Loss for the dual band antenna 134 relative to the commercially available comparative example. This is a plot of power loss (Y-axis) relative to frequency (X-axis). Graphed line 190 shows the data for the dual band antenna 134 while graphed line 192 shows the corresponding data for the comparative example. By comparing the graphed line 190 with the graphed line 192, several things can be seen. For example, the comparative example, shown via the graphed line 192, shows a resonance (indicated at point 194) that is too low in frequency relative to the ISM-900 MHz band and a resonance (indicated at point 196) that is much too high. This means that the comparative example is not functioning as an antenna at 2.4 GHz.

Having thus described several illustrative embodiments of the present disclosure, those of skill in the art will readily appreciate that yet other embodiments may be made and used within the scope of the claims hereto attached. It will be understood, however, that this disclosure is, in many respects, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A dual band antenna configured for use with a power meter having a power meter housing, the dual band antenna comprising:

a flexible polymeric substrate;

an adhesive layer secured relative to the flexible polymeric substrate;

a first unitary conductive element disposed relative to the flexible polymeric substrate and having a first electrical length;

a second unitary conductive element disposed relative to the flexible polymeric substrate and having a second electrical length;

a coaxial lead including a first conductor electrically coupled with the first unitary conductive element and a second conductor electrically coupled with the second unitary conductive element;

wherein the first electrical length and the second electrical length are substantially the same and the first unitary conductive element and the second unitary conductive element in combination form a single branch dual band antenna.

2. The dual band antenna of claim 1, wherein the first unitary conductive element and the second unitary conductive element are configured to provide the dual band antenna with a first receiving band that is centered between 902 MHz and 928 MHz of the ISM-900 MHz band.

3. The dual band antenna of claim 2, wherein the same first unitary conductive element and the same second unitary conductive element are configured to provide the dual band antenna with a second receiving band that is centered between 2.4 GHz and 2.5 GHz.

4. The dual band antenna of claim 1, wherein the first unitary conductive element and the second unitary conductive element are configured to provide the dual band antenna with a second receiving band that is centered between 2.4 GHz and 2.5 GHz.

5. The dual band antenna of claim 1, wherein when the dual band antenna is secured to the power meter housing, the dual band antenna is polarizing in a vertical direction, thereby increasing its horizontal sensitivity.

6. The dual band antenna of claim 1, wherein when the dual band antenna is secured to the power meter housing, the coaxial lead, the first conductor, and the second conductor situated behind the flexible polymeric substrate and not visible.

7. The dual band antenna of claim 1, wherein when the dual band antenna is secured to the power meter housing, a visible difference between a color of the dual band antenna relative to a color of the adjacent power meter housing is less than the just a noticeable difference (JND).

8. The dual band antenna of claim 1, wherein when the dual band antenna is secured to the power meter housing, the first conductive element includes:

a first portion extending toward a front of the power meter housing; and a second portion extending from the first portion and laterally of the first portion.

9. The dual band antenna of claim 8, wherein when the dual band antenna is secured to the power meter housing, the second conductive element includes:

a first portion extending toward a front of the power meter housing; and a second portion extending from the first portion and laterally of the first portion;

wherein the second portion of the second conductive element extends in an opposite direction from that of the second portion of the first conductive element.

10. The dual band antenna of claim 9, further comprising a removable liner disposed over the adhesive layer.

11. The dual band antenna of claim 1, wherein the first conductive element and the second conductive element comprise a copper foil.

12. The dual band antenna of claim 1, wherein the flexible polymeric substrate comprises:

a first polymeric layer forming a front of the flexible polymeric substrate;

a second polymeric layer behind the first polymeric layer, with the first conductive element and the second conductive element secured between the first polymeric layer and the second polymeric layer; and an adhesive layer behind the second polymeric layer.

13. The dual band antenna of claim 12, wherein the first polymeric layer comprises a electrically insulating layer of a polyimide that has been provided a color that is less than the just a noticeable difference (JND) from the color of the power meter housing.

14. The dual band antenna of claim 12, wherein the second polymeric layer comprises an electrically insulating layer of a polyimide.

15. An antenna assembly configured for use with a power meter having a power meter housing with a curved side wall, the antenna assembly comprising:

a flexible substrate configured to fit about at least a portion of the curved side wall of the power meter housing; and a dual band single branch antenna secured relative to the flexible substrate, the dual band antenna configured to have, when curved around the curved side wall of the power meter housing, a first resonance peak between 902 MHz and 928 MHz of the ISM-900 MHz band and a second resonance peak between 2.4 GHz and 2.5 GHz, where the dual band single branch antenna is vertically polarizing thereby increasing its horizontal sensitivity.

16. The antenna assembly of claim 15, wherein the antenna assembly has an outer appearance that renders the antenna assembly difficult to see, except at close distance, when the antenna assembly has been secured to the power meter housing.

17. The antenna assembly of claim 15, wherein the dual band single branch antenna comprises a pair of electrically separated conductive elements that have an at least substantially equal electrical length.

18. A power meter configured for use with a power socket, the power meter comprising:

a power meter housing defining a curved side wall;

a power meter disposed within the power meter housing;

a dual band single branch antenna coupled to the curved outer facing side wall of the power meter housing, the dual band single branch antenna providing, when curved around the curved side wall of the power meter housing, a first resonance peak between 902 MHz and 928 MHz of the ISM-900 MHz band and a second resonance peak between 2.4 GHz and 2.5 GHz; and a clear cover disposed over the power meter housing and the dual band single branch antenna.

19. The power meter of claim 18, wherein the power meter housing has a housing color and the dual band single branch antenna has a color that is at least substantially similar to the housing color, and wherein the dual band single branch antenna is configured to cover a coaxial lead connecting the dual band single branch antenna to the power meter disposed within the power meter housing.

20. The power meter of claim 18, wherein the dual band single branch antenna is vertically polarized.

* * * * *